United States Patent [19]

Dopyera

[11] 4,068,553

[45] Jan. 17, 1978

[54] STRINGED MUSICAL INSTRUMENT

[76] Inventor: John Dopyera, 1206 S. Escondido, Escondido, Calif. 92025

[21] Appl. No.: 674,378

[22] Filed: Apr. 7, 1976

[51] Int. Cl.[2] ..... G10D 3/02; G10D 1/08

[52] U.S. Cl. ..... 84/296; 84/267

[58] Field of Search ..... 84/291, 293, 294, 296, 84/270, 410, 173, 267, 295, 230

[56] References Cited

U.S. PATENT DOCUMENTS

| | | | |
|---|---|---|---|
| 1,762,617 | 6/1930 | Dopera | 84/296 |
| 2,027,723 | 1/1936 | Dopera | 84/296 |
| 2,045,265 | 6/1936 | Dopera | 84/296 |
| 3,931,753 | 1/1976 | Dopera | 84/296 |

*Primary Examiner*—Stephen J. Tomsky
*Attorney, Agent, or Firm*—Edward D. O'Brian

[57] ABSTRACT

A stringed musical instrument having an instrument body, a neck mounted on and extending from said body, and at least one string, an end of which is secured to the extremity of the neck remote from said body and an end of which is secured to said body, this string being under tension and extending adjacent to the neck and the body between its ends, can be improved by pivotally mounting the neck on the body and by using a cam and cam follower structure to adjust the position of the neck relative to the body. The cam and cam follower structure is employed so as to equalize the component of the force exerted by the string on the neck tending to deform the neck. Preferably the instrument has two somewhat flexible resonator structures within the body of the instrument and means connecting both of the resonator structures to a bridge supporting the string or strings of the instrument. These connecting means are employed to transmit vibration to both of the resonator structures.

3 Claims, 4 Drawing Figures

10
12
14
16
18
20
22
24
26
28
30
32
34
36
38
40
42
44
46
48
50
52
54
56
58
60
62
64
66
68
70
72
74
76
78
80
82
84
86
88
90
92
94
95
96
98
100
102
104
106
108
110
112
2

24
80
82
84
88
95
96
98
100
102
104

60
64
66
68
72
76
80
82
86

12
32
36
44
46
48
50
52
54
56
58
60
62
64
66
68
70
76
78
98

STRINGED MUSICAL INSTRUMENT

BACKGROUND OF THE INVENTION

The invention set forth in this specification pertains to new and improved musical instruments. More specifically it pertains to stringed musical instruments which are constructed in such a manner that the necks of such instruments may be adjusted so as to compensate for any neck deformation caused by the tension of the string or strings in such an instrument. The invention also pertains to stringed musical instruments in which two flexible resonators are mounted so as to each receive vibrations through the bridge of the instrument so as to produce a desired tonal effect.

Stringed musical instruments of a wide variety of different types have been commonly employed for many centuries. In spite of the fact that the field of such instruments is extremely old it is considered that there is still a need for improvement in the construction of such instruments. This can be illustrated in several different ways. As such instruments are normally constructed they utilize an instrument body carrying a neck mounted on the body so as to extend from it and one or more strings mounted so as to extend from the end of the neck away from the body generally across the body. These strings are normally used so as to rest upon a bridge mounted on the body in such a manner that as the strings are caused to vibrate the vibrations of the strings will set up sounds which are reinforced in various ways and to various extents by the instrument body.

The tension on the string or strings in such an instrument provides a force component which tends to distort and/or pivot the neck relative to such an instrument body. While this force component is normally not overly significant in instruments employing only a single string it can be quite material in the case of an instrument such as a 12-string guitar employing a plurality of strings under tension. The force component noted will frequently in time cause the neck of an instrument to deform out of an intended or initial shape. This will tend to result in the strings of such an instrument being held in other than a desired manner along the instrument neck and body. This is considered to affect the playability of the instrument and in some cases the character of the tone produced by the instrument.

The latter is considered to be particularly important since it is normally desired that the tone qualities of a musical instrument remain unchanged throughout the life of the instrument. A number of factors affect tone qualities. For reasons which are unimportant to an understanding of the present invention it is often desired to utilize in connection with certain types of music stringed musical instruments of a so-called resonator type. Such instruments are constructed so as to provide mechanical connection between the bridge on the instrument and one or more somewhat flexible, dome-like, somewhat diaphragm-like resonator structures within the body of the instrument which move or resonate in accordance with vibrations of the strings of such an instrument.

Musical instruments employing such structures or resonators have been referred to as resonator-type instruments and as amplifier-type instruments. Instruments of this type have been constructed under the trademark "DOBRO" and are commonly utilized in playing a style of music referred to as "blue grass." Such resonator stringed instruments have, however, been utilized in connection with other types of music. Most generally, these resonator-type musical instruments have taken the form of guitars, although the type of construction employed with them has been employed in other stringed instruments such as violins.

SUMMARY OF THE INVENTION

A broad object of the present invention is to provide new and improved stringed musical instruments. Another objective of the present invention is to provide stringed instruments which are constructed in such a manner that the necks employed with them are capable of being adjusted so as to compensate for any distortion or deformation caused by the force exerted on the necks by the strings in such instruments. A further objective of the present invention is to provide stringed musical instruments utilizing several resonators so as to obtain a desirable tonal effect.

A further objective of the present invention is to provide stringed musical instruments which are constructed in such a manner that neck adjustment as provided in accordance with the invention can be accommodated within the instrument along with the resonators used. Further objectives of the present invention are to provide instruments as herein described which may be constructed without any extensive difficulty, which have desirable tonal characteristics, which may be utilized for a prolonged period and which may be adjusted as may be required as they are utilized with a minimum of difficulty.

In accordance with this invention these objectives are achieved in a stringed musical instrument having an instrument body, a neck mounted on and extending from the body, and at least one string, an end of which is secured to the extremity of the neck remote from the body and an end of which is secured to the body, this string being under tension and extending adjacent to the neck and the body between its ends, the tension on the string exerting a force component on the neck tending to distort the neck relative to the body, by providing the improvement which comprises: the neck being pivotally mounted on the body and adjustable means for pivoting the neck relative to the body so as to move the neck to compensate for any movement caused by the noted force component.

An instrument having the various parts which are considered to be old in the preceding and which also includes a single resonator mounted within the body of the instrument preferably includes the improvement which comprises: a second resonator located within the body so as to be spaced from the first resonator and means connecting both of the resonators to a bridge of the instrument supporting the string or strings of the instrument. A preferred stringed instrument in accordance with the invention is constructed so as to have a pivotally mounted neck and adjustment means as previously indicated together with two resonators as indicated in the preceding sentence. In accordance with the principles of the invention such an instrument is constructed so as to accommodate the adjustment means within the instrument body in proximity to the resonators in such a manner that the adjustment means do not interfere with the resonators.

BRIEF DESCRIPTION OF THE DRAWING

Further details of the present invention are best described with reference to the accompanying drawing in which.

The invention indicated in this specification employs certain concepts or principles as are set forth and defined in the appended claims. The illustrated structure shows one manner in which these concepts or principles may be utilized. It is to be understood that these concepts or principles can be employed in somewhat differently constructed and somewhat differently appearing stringed musical instruments through the use of exercise of routine engineering skill.

DETAILED DESCRIPTION

Figure 1:
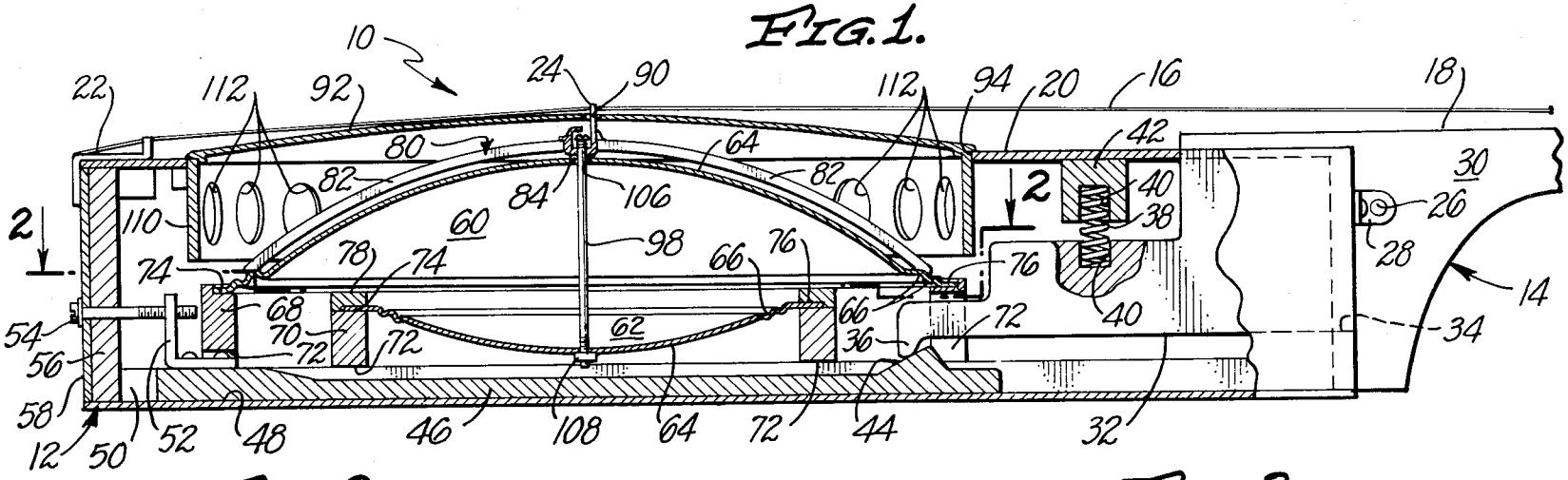
FIG. 1 is a side elevational view, partially in section, of a presently preferred embodiment or form of a stringed musical instrument in accordance with this invention.
Figure 3:
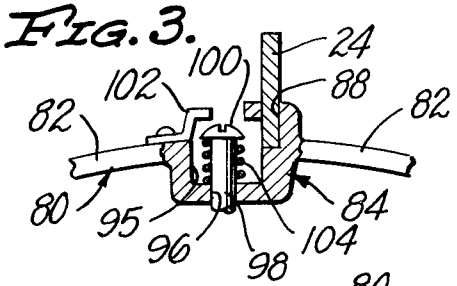
FIG. 3 is a fragmentary cross-sectional view at an enlarged scale showing the connection of the bridge used in the instrument to other parts as hereinafter indicated.
Figure 4:
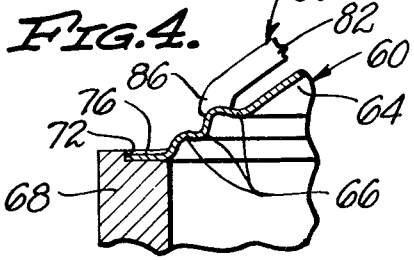
FIG. 4 is a fragmentary cross-sectional view at an enlarged scale showing the contact of an arm of a spider-like support with a part of the periphery of a resonator in the instrument shown.
Figure 2:
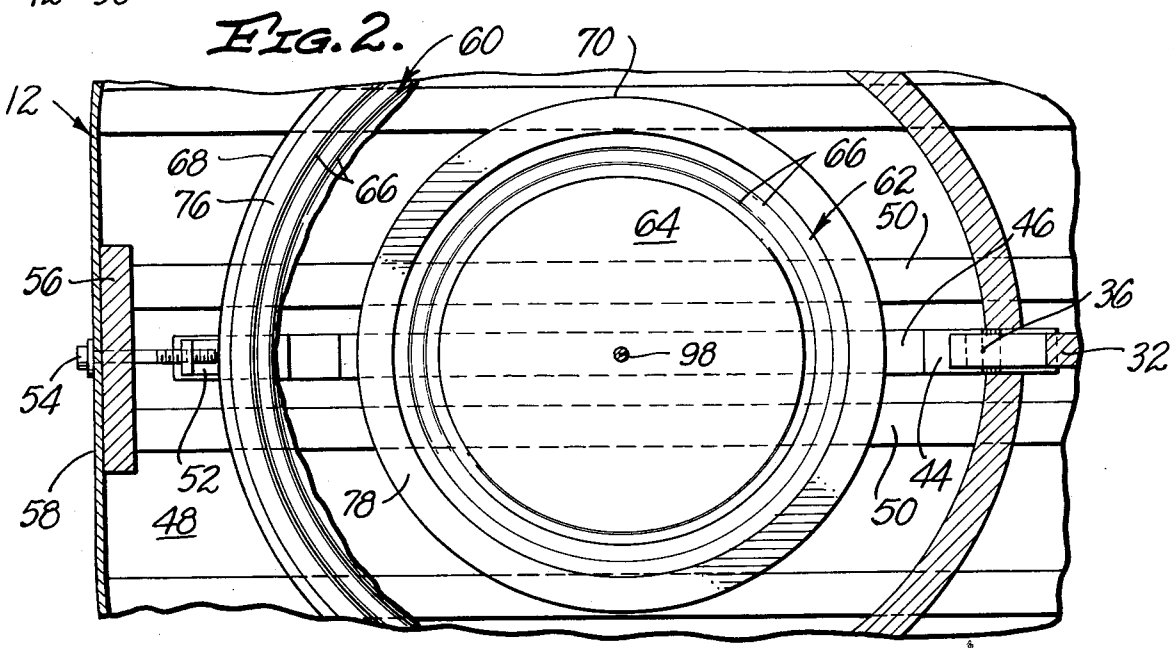
FIG. 2 is a cross-sectional view taken at line 2—2 of FIG. 1.

The invention is best more fully described by referring to the accompanying drawing. In the drawing there is shown a part of a guitar 10 having an instrument or guitar body 12 used to support an elongated neck 14. This neck 14 is shown in FIG. 1 as being broken off. It is to be understood that the portion of the neck 14 not illustrated is of a conventional character and is provided with means (not shown) located on the end of the neck 14 remote from the body 12 of a conventional type for holding strings 16 under tension so that these strings 16 extend along and are spaced from the upper surface 18 of the neck 14 and generally across the top 20 of the body 12. The ends of the strings 16 remote from the neck 14 are secured in place by means of a conventional tailpiece 22 located on the body 12. These strings 16 are held under sufficient tension so as to resiliently bear against a bridge 24 extending from the top 20.

In the guitar 10 the neck 14 is secured to the body 12 by means of a pivot 26 extending between small brackets 28 on opposed sides 30 of the neck 14. These brackets 28 are secured to the body 12 in any convenient manner. This neck 14 also includes an extension 32 extending internally of the body 12 through an opening 34 located between the brackets 28. This extension terminates in a downwardly directed, hook-like end 36 serving as a cam follower. A small coil spring 38 extending between holes 40 in the extension 32 and in a brace 42 in the body 12 normally serves to bias the extension 32 downwardly into engagement with a cam surface or cam 44.

This cam 44 is located on an elongated member 46 positioned on the bottom 48 of the body 12 between rails 50. These form a part of the body 12 and serve to reinforce this bottom 48. This member 46 is secured to an upstanding bracket 52 which is engaged by a threaded fastener 54. The fastener 54 extends through a brace 56 in the body 12 to the exterior of the rear 58 of the body 12. Through the use of an appropriate manipulative tool such as a screwdriver the fastener 54 may be turned to move the member 46 and the cam 44 linearly in the general direction of the length of the neck 14. During such movement the neck 14 will be moved as a result of contact with the follower 36 so as to be pivoted about the pivot 26.

The cam 44, the follower 36 and the various parts associated with these parts constitute an adjustable means or structure for use in pivoting the neck 14 relative to the body 12. The strings 16 used in the guitar 10 will, because they are held under tension, exert a force on the neck 14 having a component which will tend to distort and/or deform and/or pivot the neck 14 after a prolonged period. With the indicated structure the member 46 and the cam 44 may be moved as required through actuation of the fastener 54 in a direction which is opposite to the direction that the neck 14 will tend to be distorted by the tension applied by the strings 16. By virtue of the fact that the structure described is capable of being used to move the neck 14 in this manner the position of the neck 14 can be adjusted to compensate for any distortion of the neck 14 with a minimum of difficulty.

It is considered significant that this adjustment is achieved in a body 12 which is equipped with two separate resonators 60 and 62. Both of these resonators include a solid domed central portion 64 surrounded by continuous peripheral corrugations. Although these resonators 60 and 62 may be made out of a variety of materials it is considered that they are preferably made out of a somewhat resilient metal, such as aluminum or the like, which is sufficiently resilient so that the peripheral corrugations 66 will flex to a limited extent as the guitar 10 is used. The resonator 60 is of larger diameter than the resonator 62 and is mounted on a ring 68 carried by the bottom 48. The resonator 62 is mounted on a similar ring 70 which is also mounted upon the bottom 48. These rings 68 and 70 are provided with notches 72 capable of accommodating the member 46 and the extension 32. Both the rings 68 and 70 are provided with grooves 74 which are adapted to hold and support the peripheries 76 of the resonators 60 and 62.

In the guitar 10 the periphery 76 of the resonator 62 is secured in place by means of a small clamp ring 78 of the same diameter as the ring 70. These rings 70 and 78 are secured together in any convenient manner, such as by conventional fasteners (not shown). Although a similar clamp ring may be utilized in connection with the resonator 60 it is not considered necessary to use such a clamp ring 78 in connection with this resonator 60 because of the other elements employed. With the illustrated construction a rigid spider 80 having arms 82 extending away from a central or hub portion 84 is constructed so that the arms will fit around and be spaced from the central portion 64 of the resonator 60. These arms 82 rest upon and are provided with curved ends 86 shaped so as to fit precisely against and in conformity with the corrugation 66 of the resonator 60 located closest adjacent to the center of this resonator 60.

The central portion 84 is provided with a slot 88 into which the bridge 24 is fitted so as to extend upwardly and outwardly from the body 12 through an opening 90 in a perforate cover 92 extending across an opening 94 in the top 20. This central portion 84 is also provided with a cavity-like recess 95 connecting with a vertically directed hole 96 through which there projects an elongated bolt 98 having a slotted head 100. If desired a small guard 102 may be mounted on the central portion 84 so as to partially cover this head 100. A small coil spring 104 is located in the recess 95 around the bolt 98 so as to bear against the head 100. This bolt 98 projects through a small opening 106 in the central portion 64 of the resonator 60 and another corresponding opening in the resonator 62. A nut 108 is located on the bolt 98 so as to bear against the resonator 62 in such a manner that the spring 104 is always under a degree of compression and in such a manner as to hold the resonator 62 in a slightly compressed position. By virtue of the action of the spider 80 when the resonator 62 is so held the resonator 60 is also similarly held under a slight degree of compression.

With this structure when the strings 16 are caused to vibrate the bridge 24 will transmit the vibration through the spider 80 to the resonator 60. Concurrently vibration will be transmitted through the spider 80 to the resonator 62. As a consequence of this both resonators 60 and 62 will tend to "pump" or move in a degree of synchronism with one another as the strings 16 are vibrated while the guitar 10 is played. This is considered to produce a desired tonal effect making the guitar 10 particularly desirable in achieving certain types of sound effects as is desired with certain types of music, such as so-called "blue grass" music.

Such effects may be altered or modified in many ways. One manner is by the use of a ring-like sound baffle 110 provided with large openings 112 located on the body 12 so as to be dependent from the top 20 and so as to be spaced from the resonator 60. Such a baffle 110 is considered to facilitate desired tonal characteristics being achieved. Other tonal characteristics can be obtained by providing openings (not shown) corresponding to the openings 112 in either one or both of the rings 68 and 70.

Further, with the described structure the tonal characteristics can be adjusted as desired by varying the tension or compression on the resonators 60 and 62 by tightening the bolt 98 by engaging the head 100 with an appropriate manipulative tool. In order that the bolt 98 may be adjusted in this manner without the guitar 10 being disassembled, it is preferred to secure the nut 108 against rotation as, for example, by securing this nut 108 to the resonator 62 through the use of a small amount of a conventional adhesive.

The guitar 10 is considered to be quite desirable because it incorporates several cooperating features. By means as described the position of the neck 14 can be varied so as to compensate for tension caused distortion. By virtue of the structure indicated such means are accommodated in an inconspicuous manner within the body 12 in such a way as to permit the use of the two resonators 60 and 62 in what may be regarded as a face-to-face position in which both of the resonators 60 and 62 are mechanically connected to the bridge 24 so as to both receive vibration causing their movement from the bridge 24 as the guitar 10 is played. By virtue of the structure described the guitar 10 is considered to be a relatively compact instrument which, from its exterior, does not indicate the specialized character of the construction employed within it.

I claim:

1. A stringed, resonator type musical instrument having an instrument body, a neck mounted on and extending from said body, at least one string extending along said neck and across the top of said body, a bridge engaging and supporting said string on said body, and a resonator means located in said body generally beneath said bridge and mechanically connected to said bridge in which the improvement comprises:

a second resonator means located within said body generally parallel to said first mentioned resonator means beneath said first resonator means, and mechanical means for transmitting vibration from said bridge to both of said resonator means, said mechanical means including a rigid spider having a centrally located hub and a rod extending from said hub, said bridge being mounted on said hub so as to extend therefrom, the ends of the legs of said spider remote from said hub engaging said first resonator means adjacent to the periphery of said first resonator means, said rod extending through said first resonator means adjacent to the periphery of said first resonator means, said rod extending through said first resonator means adjacent to the center thereof and connecting said hub with the center of said second resonator.

2. A stringed musical instrument as claimed in claim 1 wherein:

the tension on said rod is capable of being adjusted so as to vary the response of said second resonator means to vibration.

3. A stringed musical instrument as claimed in claim 2 wherein:

said resonator means each have solid domed central portions surrounded by continuous, peripheral corrugations and are sufficiently resilient so that said peripheral corrugations will flex during the use of said instrument, said ends of said legs on said spider remote from said hub engaging corrugations in said first resonator means.

* * * * *